US008572820B2

(12) United States Patent
Richards

(10) Patent No.: US 8,572,820 B2
(45) Date of Patent: Nov. 5, 2013

(54) DUAL RELEASE BUCKLE

(75) Inventor: Marvin Richards, Gilbert, AZ (US)

(73) Assignee: BAE Systems Specialty Defense Systems of Pennsylvania, Inc., Jessup, PA (US)

( * ) Notice: Subject to any disclaimer, the term of this patent is extended or adjusted under 35 U.S.C. 154(b) by 144 days.

(21) Appl. No.: 13/111,367

(22) Filed: May 19, 2011

(65) Prior Publication Data

US 2012/0124790 A1 May 24, 2012

Related U.S. Application Data

(60) Provisional application No. 61/347,252, filed on May 21, 2010.

(51) Int. Cl.
*A44B 11/26* (2006.01)

(52) U.S. Cl.
USPC ..... 24/634; 24/648

(58) Field of Classification Search
USPC ..... 24/313, 631, 632, 648, 650, 593.1, 640, 24/641, DIG. 52
See application file for complete search history.

(56) References Cited

U.S. PATENT DOCUMENTS

| | | | | | |
|---|---|---|---|---|---|
| 1,209,369 | A | * | 12/1916 | Wood | 24/648 |
| 2,518,889 | A | * | 8/1950 | Henderson | 24/313 |
| 2,941,272 | A | * | 6/1960 | Bourguignon | 24/657 |
| 3,168,770 | A | * | 2/1965 | John, Jr. et al. | 24/648 |
| 3,453,702 | A | * | 7/1969 | Alofs | 24/637 |
| 3,605,210 | A | * | 9/1971 | Lohr | 24/635 |
| 3,649,999 | A | * | 3/1972 | Stoffel | 24/635 |
| 3,713,192 | A | | 1/1973 | Wallin | |
| 3,789,467 | A | * | 2/1974 | Aratani et al. | 24/648 |
| 4,321,734 | A | * | 3/1982 | Gandelman | 24/648 |
| 4,334,341 | A | * | 6/1982 | Krautz et al. | 24/635 |
| 4,578,844 | A | * | 4/1986 | Gelula | 24/631 |
| 4,602,406 | A | * | 7/1986 | Gelula | 24/645 |
| 5,561,891 | A | * | 10/1996 | Hsieh | 24/581.1 |
| 5,806,148 | A | | 9/1998 | McFalls et al. | |
| 6,154,935 | A | | 12/2000 | Gregory et al. | |
| 6,487,761 | B2 | | 12/2002 | Van Tassel | |
| 6,668,434 | B2 | | 12/2003 | Casebolt et al. | |
| 7,155,786 | B2 | | 1/2007 | Grimm | |
| 7,350,277 | B1 | * | 4/2008 | Canfield et al. | 24/634 |

(Continued)

FOREIGN PATENT DOCUMENTS

| | | |
|---|---|---|
| DE | 19 27 100 A1 | 12/1970 |
| DE | 196 47 631 | 5/1998 |

(Continued)

OTHER PUBLICATIONS

PCT International Application No. PCT/US2011/037154, International Search Report and Written Opinion dated Aug. 19, 2011.

(Continued)

*Primary Examiner* — Robert J Sandy
*Assistant Examiner* — David Upchurch
(74) *Attorney, Agent, or Firm* — Kane Kessler, P.C.; Paul E. Szabo

(57) ABSTRACT

A dual release buckle can be released either as a side-release buckle or as a remotely-released cable actuated buckle and can be incorporated into a garment, for example, a soldier's vest.

11 Claims, 5 Drawing Sheets

(56) References Cited

U.S. PATENT DOCUMENTS

| | | | | |
|---|---|---|---|---|
| 7,373,701 | B2 | 5/2008 | Coulombe et al. | |
| 7,448,116 | B1 | 11/2008 | Howell | |
| 7,520,036 | B1 * | 4/2009 | Baldwin et al. | 24/635 |
| 2002/0092140 | A1 | 7/2002 | Van Tassel | |
| 2003/0074772 | A1 | 4/2003 | Chen | |
| 2003/0145435 | A1 | 8/2003 | Carver | |
| 2006/0080811 | A1 | 4/2006 | Grimm | |
| 2008/0066268 | A1 | 3/2008 | Hampton | |
| 2010/0313392 | A1 | 12/2010 | Anscher | |
| 2011/0030180 | A1 | 2/2011 | Parisi et al. | |

FOREIGN PATENT DOCUMENTS

| | | | |
|---|---|---|---|
| DE | 10 2007 058124 | A1 | 6/2009 |
| FR | 2 926 009 | | 7/2009 |
| WO | 2009134608 | | 11/2009 |
| WO | WO 2011/079203 | A1 | 6/2011 |

OTHER PUBLICATIONS

PCT Application No. PCT/US2011/037154; International Preliminary Report on Patentability dated Dec. 6, 2012.

PCT International Application No. PCT/US10/61822, International Search Report and Written Opinion dated Apr. 14, 2011.

* cited by examiner

DUAL RELEASE BUCKLE

RELATED APPLICATION

This application claims the benefit of U.S. Provisional Application No. 61/347,252, filed May 21, 2010, the entire disclosure of which is incorporated by reference.

BACKGROUND

This invention relates to a dual release buckle that can be released either as a typical side-release buckle, or as a remotely-released cable/lanyard actuated buckle. The buckle can be incorporated into a garment, for example, a soldier's vest. In such an application, portions of the vest are releasably held together by fasteners such as buckles. The buckles are normally fastened and released one at a time by manually engaging them. In an emergency situation, it is desirable to be able to release all the buckles of a vest at one time, with one pull on, for example, a pull tab located on the front of the vest.

BRIEF DESCRIPTION OF THE DRAWINGS

Features of the invention will become apparent to one of ordinary skill in the art to which the invention pertains from a reading of the following description together with the accompanying drawings, in which.

DETAILED DESCRIPTION

Figure 1:
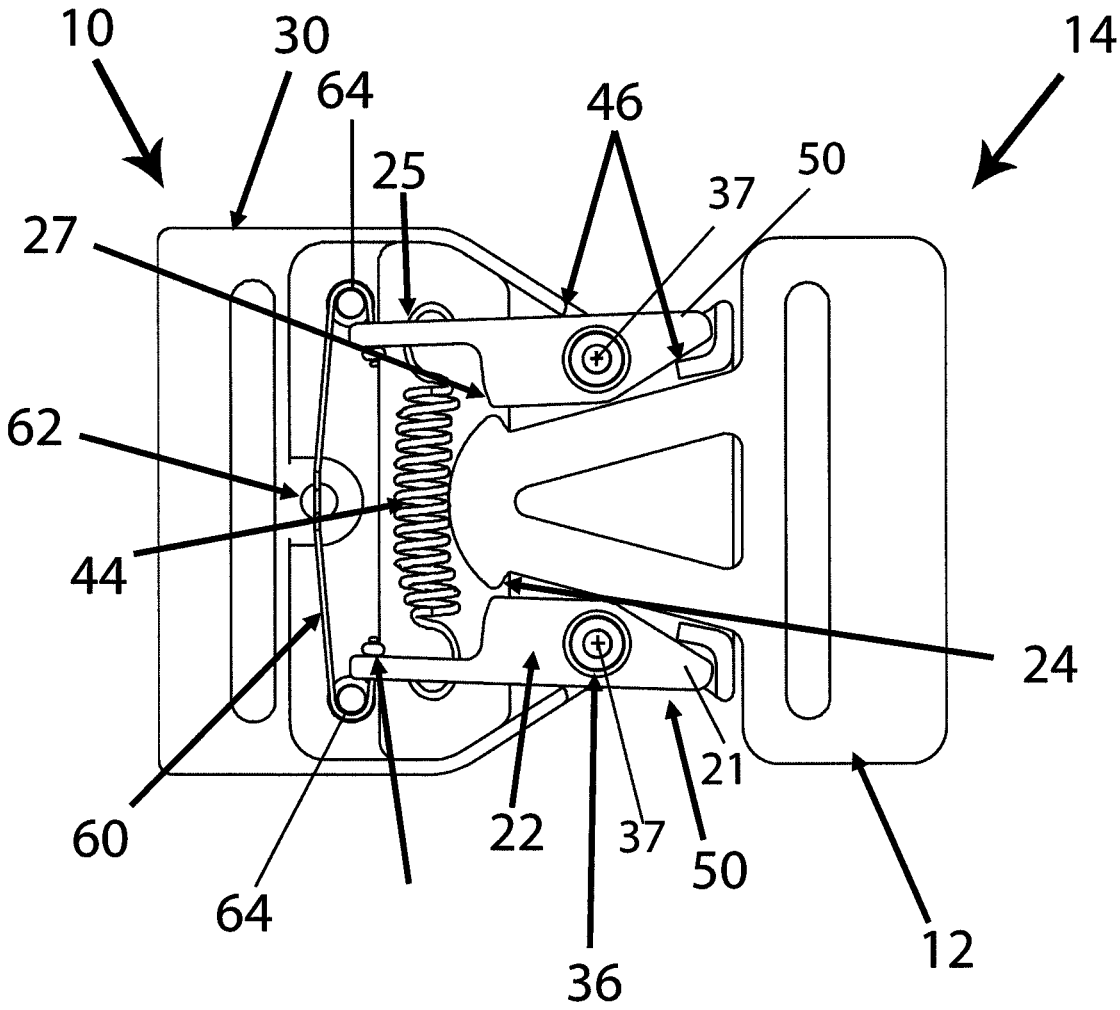
FIG. 1 is a schematic top plan illustration of a buckle assembly including a buckle that is an embodiment of the invention and having portions cut away, the buckle assembly also including a tongue shown in a locking position in engagement with the buckle.
Figure 2:
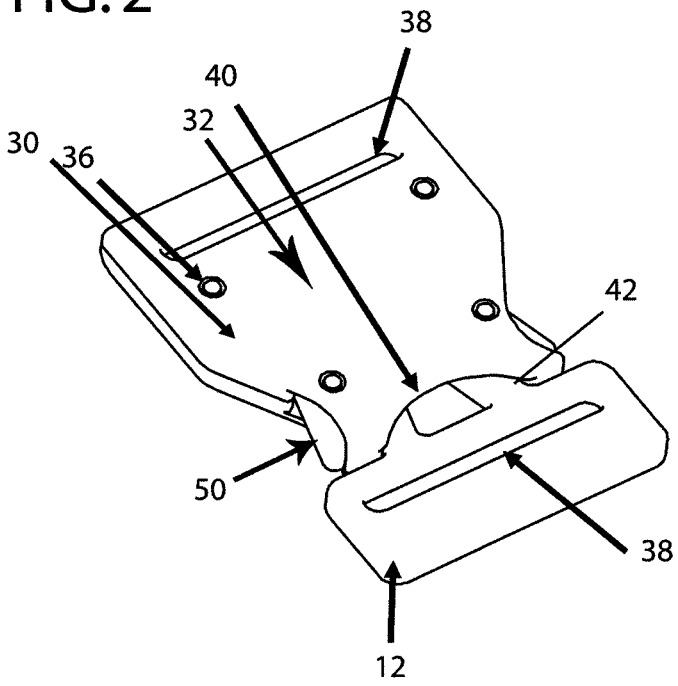
FIG. 2 is a schematic top perspective view of the engaged buckle assembly.
Figure 3:
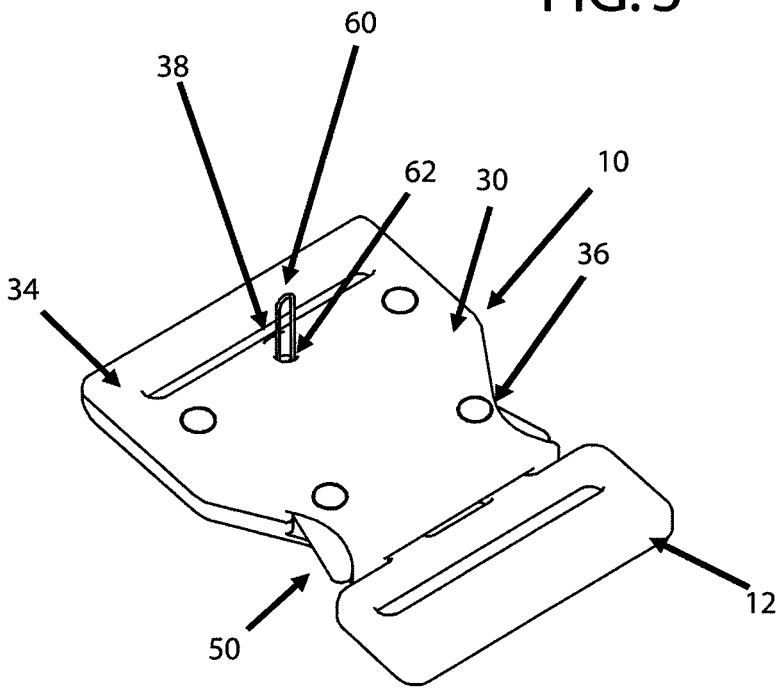
FIG. 3 is a schematic bottom perspective view of the engaged buckle assembly.

This invention relates to a dual release buckle that can be released either as a typical side-release buckle, or as a remotely-released, cable/lanyard-actuated buckle. The buckle can be incorporated into a garment, for example, a soldier's vest. As representative of the invention, FIG. 1 illustrates a buckle 10 that, together with a tongue 12, forms a buckle assembly 14.

The tongue 12 (FIGS. 1-4) has an arrow-shaped leading end portion 20 that includes two buckle locking surfaces 24. The outer end portion 26 of the tongue 12 has a webbing slot 28 by which belt webbing or a strap can be attached. In some embodiments, this slot 28 may also contain a sliding element (not shown) that enables webbing to be passed around it and through the slot in a typical webbing adjuster fashion.

The buckle 10 (FIGS. 1-3) includes a base or housing 30 having a front side 32 (away from the user's body when worn) and a back side 34 (body side) connected by a plurality of housing fasteners 36. A webbing slot 38 is formed in the housing 30. The housing 30 also has a guide feature 40 for helping to guide the leading end portion 20 of the tongue 12 into the buckle 10. The guide feature 40 defines an entrance opening 42 into a passage 43 in the buckle 10.

The buckle has two pawls 22 that are supported by pawl pivot/housing fasteners 36 for pivotal movement relative to the housing 30 about pivot axes 37. Each pawl has a first end portion 21 and, on the opposite side of the pawl pivot axis 37, a second end portion 25. Each pawl also has a locking surface 29. The two pawls 22 are located on the opposite sides of the buckle 10, on opposite sides of the passage 43.

Figure 4:
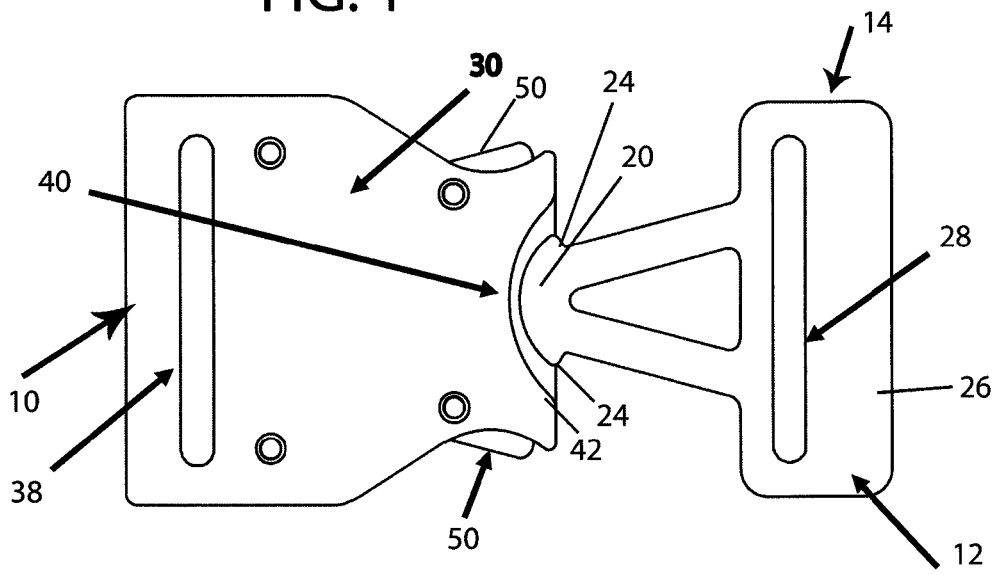
FIG. 4 is a schematic top plan view of the buckle assembly showing the tongue separated from the buckle.

A lock spring/ejection spring 44 in the housing 30 extends between the second end portions 24 of the pawls 22 and biases them to a locking position as shown in FIG. 4. The spring 44 is preferably a tension coil spring held in tension between the pawls 22. The spring acts to pivot the pawls 22 so as to pull the pawl second end portions 25 toward each other. The housing 30 has multiple pawl stop surfaces 46 for limiting the pivotal movement of the pawls 22 in opposite directions.

The tongue leading end portion 20 is designed to push the pawls 22 of the buckle 10 out of the way during engagement (insertion of the tongue into the buckle). The shape and angle of the buckle locking surfaces 24 on the tongue 12 are such that, when they are engaged with the pawls 22 as described below, the buckle assembly 14 will not disengage under tension loading.

The pawls 22 contain protrusions or side portions 50 that are exposed on the sides of the buckle 10 and that serve as side-release actuation surfaces. Thus, the pawls 22 can be disengaged from contact with the tongue 12 by applying opposing compressive (inwardly directed) forces to the actuating surfaces 50. This is the primary release mechanism for the buckle 10.

As a secondary release mechanism, a cable or release lanyard 60 is connected with the pawls 22. (The term "cable" is used herein to refer to any flexible, elongate member that can serve this function; the part is often called a "lanyard" in this particular military vest application.) Specifically, the housing front side portion 32 has a release lanyard hole 62 (FIG. 2) through which a central portion of the release lanyard 60 extends. End portions 64 of the lanyard 60 (FIG. 3) wrap around posts on the housing 30 and are connected with the second end portions 25 of the pawls 22.

Figure 5:
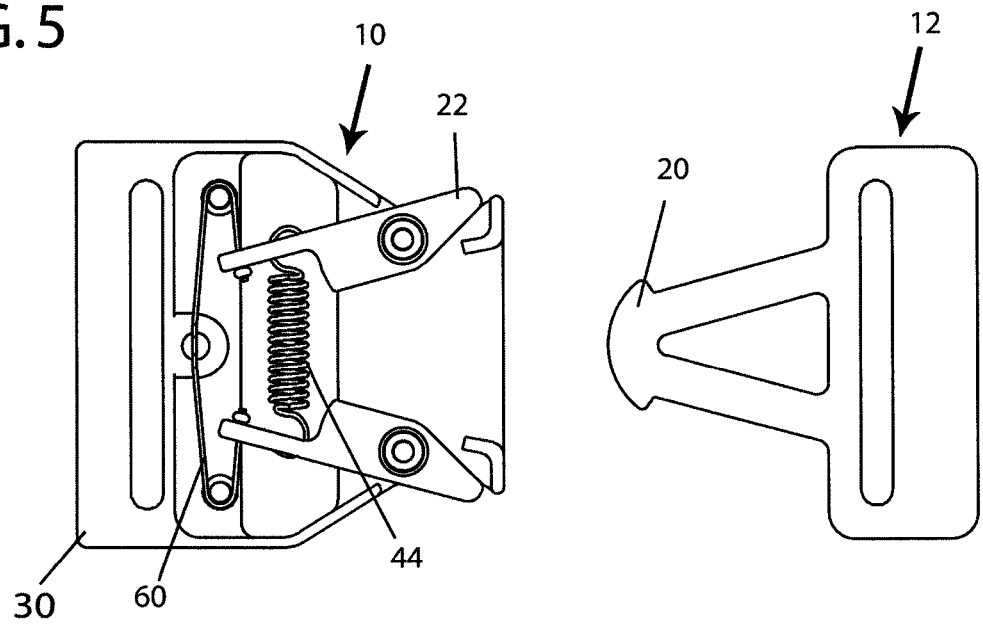
FIGS. 5-9 are a series of views similar to FIG. 4 showing the parts of the buckle assembly in different operative positions.
Figure 6:
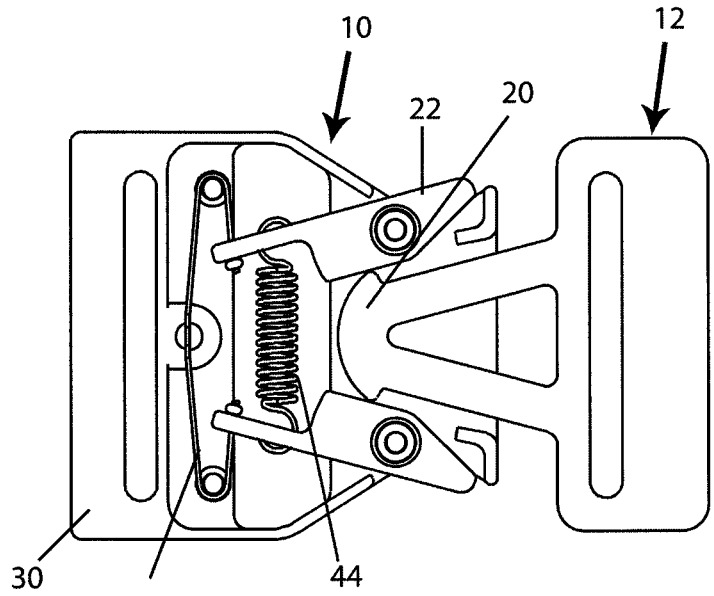

In the absence of external forces, the relative position of the pawls 22 is controlled by the spring 44. FIGS. 4-8 illustrate several different positions of the parts of the buckle assembly. In FIG. 4, the tongue 12 and the buckle 10 are disengaged. FIG. 5 shows partial engagement, with the tongue 12 engaging the first end portions 21 of the pawls 22 and pivoting the pawls part way against the biasing force of the spring 44. FIG. 6 shows further engagement of the tongue 12 with the pawls 22.

Figure 7:
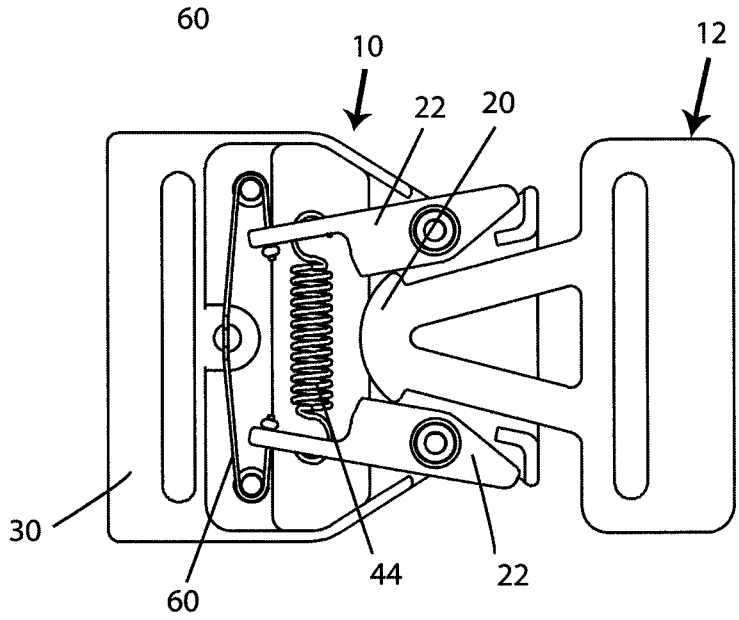

FIG. 7 shows the tongue 12 fully engaged with the buckle 10. The pawls 22 are in a locking position. The pawl locking surfaces 29 on the pawls are engaged with the buckle locking surfaces 24 on the tongue 12. The leading end portion 20 of the tongue 12 is engaging and deflecting the spring 44. The buckle assembly 14 is in a locked configuration.

Figure 8:
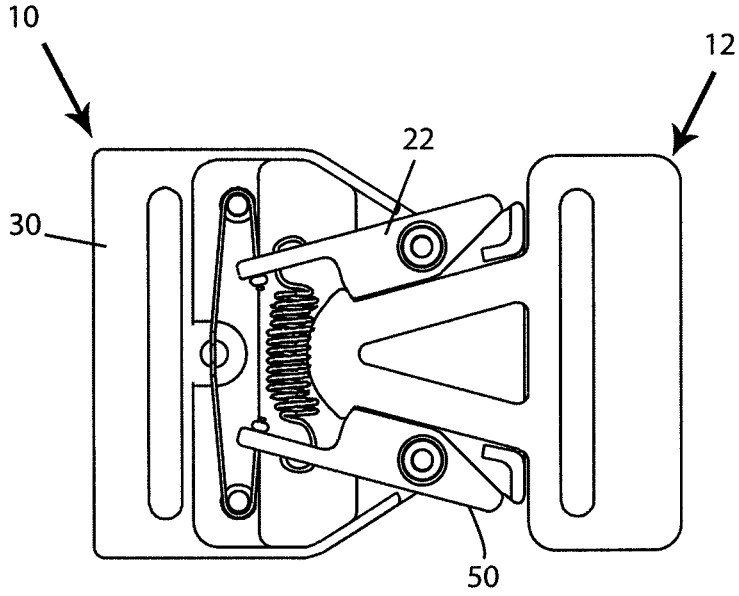
Figure 9:
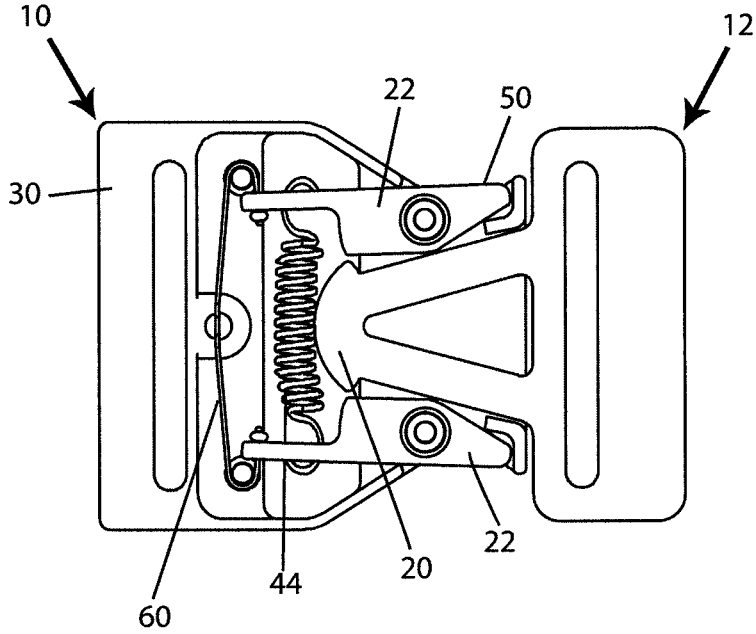

FIG. 8 shows the tongue 12 still fully engaged with the buckle 10, but the pawls 22 having been moved into a release condition caused by inwardly directed manual compressive force on the pawl actuation surfaces 50 or by a pulling force on the lanyard 60. The pawls 22 are pivoted out of engagement with the tongue 12. The tongue 12 is then ejected by the force of the spring 44 as the spring straightens itself out.

The lanyard or cable 60 used to pull on the pawls 22 can exit either the front side 32 or the back side 34 of the buckle 10, enabling it to enter or pass through an object that the buckle is in contact with (such as a garment). In the illustrated embodiment, the cable/lanyard 60 exits the front side 32 of the buckle 10. When pulling force is exerted on the cable 60, that force is transmitted to the second end portions 25 of the pawls 22 so as to pull the second end portions apart from each other, thus pivoting the pawls from the locking position to the released position.

The buckle housing 30 constrains the vertical motion (in-line with the pawl pivot axes) of the components that are internal to the housing—among them the pawls 22, the spring 44, and (when inserted) the tongue 12. The housing 30 also keeps out contaminants or other objects that may interfere with the function of the buckle assembly.

Existing plastic quick-release buckles have load limitations due to material strength. Plastic quick-release buckles have a lower fatigue life due to the repeated deformation of the plastic required to actuate the lock. The buckle 10 is preferably constructed from stamped sheet metal components and the two housing components are held together via the clamping of fasteners that serve as the pawl pivot axes. Preferably, stainless steel is used for holding strength, durability, and corrosion resistance, as well as to minimize buckle thickness. Other materials, including plastics, could be used for lower strength applications. The housing portions may be over-molded with rubber or some other compliant/resilient material. With the present invention, metallic components and pawl-type locking elements enable the buckle 10 to react higher loads than all-plastic, deformable buckles. The metallic components also enhance durability over all-plastic, deformable buckles, with greater resistance to abuse, temperature, sand and dust, moisture, and solar radiation. The use of stronger metallic components and pawl-type locking elements also enables the buckle to be thinner than plastic buckles.

The design and placement of the single spring 44 enables the buckle 10 to be released by a secondary means (cable or lanyard) with no added components. Prior art side-release buckles with pawl-type locking elements typically use two springs. The present invention incorporates more function with one fewer spring than prior art pawl-type buckles.

The invention claimed is:

1. A buckle for engagement with a tongue that is insertable into the buckle, the buckle comprising:

first and second lock pawls supported on opposite sides of a housing for pivotal movement relative to the housing between a locking position locking the tongue in the buckle and a release position enabling movement of the tongue out of the buckle;

the first and second lock pawls having respective actuating portions exposed on opposite sides of the housing;

the actuating portions of the lock pawls being manually engageable when the pawls are in the locking position to pivot the pawls from the locking position to the release position;

a cable attached to the buckle and having end portions connected with the lock pawls, the cable being configured to transmit a pulling force to the pawls to move the pawls from the locking position to the release position; and the housing having front and back sides, the housing having an aperture on one of the front or back sides through which a central portion of the cable extends from the lock pawls to a location outside the housing at which a release force can be manually applied, the central portion of the cable extending through the aperture in a direction transverse to the direction of movement of the tongue into and out of the buckle.

2. A buckle as set forth in claim 1 further comprising a single spring that biases both pawls into the locking position.

3. A buckle as set forth in claim 2 wherein the single spring also serves as an ejection spring that helps to eject the tongue when the pawls are moved from the locking position to the release position.

4. A buckle as set forth in claim 3 wherein the single spring engages the tongue when the tongue is inserted in the buckle and the pawls are in the locking position.

5. A buckle for engagement with a tongue that is insertable into the buckle, the buckle comprising:

first and second lock pawls supported on opposite sides of a housing for pivotal movement relative to the housing between a locking position locking the tongue in the buckle and a release position enabling movement of the tongue out of the buckle;

a cable attached to the buckle and connected with the lock pawls, the cable being configured to a transmit pulling force to the pawls to move the pawls from the locking position to the release position;

wherein the pawls have first and second end portions on opposite sides of their pivot axes, the first end portions being engageable by the tongue upon insertion of the tongue into the buckle, the second end portions connected with the cable and being acted upon by the pulling force of the cable; and the housing having front and back sides, the housing having an aperture on one of the front or back sides through which a central portion of the cable extends from the lock pawls to a location outside the housing at which a release force can be manually applied, the central portion of the cable extending through the aperture in a direction transverse to the direction of movement of the tongue into and out of the buckle.

6. A buckle as set forth in claim 5 wherein the pulling force acts to pull the second end portions of the pawls apart from each other.

7. A buckle as set forth in claim 5 wherein the first and second lock pawls have respective actuating portions exposed on opposite sides of the housing, the actuating portions of the lock pawls being manually engageable when the pawls are in the locking position to pivot the pawls from the locking position to the release position.

8. A buckle for engagement with a tongue that is insertable into the buckle, the buckle comprising:

first and second lock pawls supported on opposite sides of a housing for pivotal movement relative to the housing between a locking position locking the tongue in the buckle and a release position enabling movement of the tongue out of the buckle;

the first and second lock pawls having respective actuating portions exposed on opposite sides of the housing;

the actuating portions of the lock pawls being manually engageable when the pawls are in the locking position to pivot the pawls from the locking position to the release position; and a cable attached to the buckle and connected with the lock pawls for transmitting pulling force to the pawls to move the pawls from the locking position to the release position;

further comprising a single spring that biases both pawls into the locking position; and wherein the pawls have first and second end portions on opposite sides of their pivot axes, the first end portions being engageable by the tongue upon insertion of the tongue into the buckle, the second end portions being acted upon by the spring.

9. A buckle as set forth in claim 8 wherein the cable is connected with the second end portions of the pawls to move the second end portions apart from each other thereby to move the pawls from the locking position to the release position in response to the pulling force on the cable.

10. A buckle as set forth in claim 9 wherein the pulling force acts to pull the second end portions of the pawls apart from each other.

11. A buckle for engagement with a tongue that is insertable into the buckle, the buckle comprising:

first and second lock pawls supported on opposite sides of a housing for pivotal movement relative to the housing between a locking position locking the tongue in the buckle and a release position enabling movement of the tongue out of the buckle; and a cable attached to the buckle and connected with the lock pawls for transmitting pulling force to the pawls to move the pawls from the locking position to the release position;

wherein the pawls have first and second end portions on opposite sides of their pivot axes, the first end portions being engageable by the tongue upon insertion of the tongue into the buckle, the second end portions being acted upon by the pulling force of the cable;

wherein the pulling force acts to pull the second end portions of the pawls apart from each other; and further including a single spring that acts to pull the second end portions of the pawls toward each other and thus biases the pawls into the locking position.

* * * * *